United States Patent [19]

Menjo

[11] Patent Number: 5,075,732

[45] Date of Patent: Dec. 24, 1991

[54] IMAGE FORMING APPARATUS WHICH SETS FIXING ROLLER SPEED DEPENDING ON THE NUMBER OF COPIES ON THE TRANSFER DRUM

[75] Inventor: Takeshi Menjo, Tokyo, Japan

[73] Assignee: Canon Kabushiki Kaisha, Tokyo, Japan

[21] Appl. No.: 573,710

[22] Filed: Aug. 28, 1990

[30] Foreign Application Priority Data

Aug. 31, 1989 [JP] Japan ..... 1-225354

[51] Int. Cl.[5] ..... G03G 15/20

[52] U.S. Cl. ..... 355/282; 355/271; 355/285; 355/317; 355/326

[58] Field of Search ..... 355/282, 284, 285, 286, 355/289, 290, 295, 208, 316, 317, 321; 219/216, 388, 469; 432/60, 228; 34/25, 52

[56] References Cited

U.S. PATENT DOCUMENTS 4,415,256 11/1983 Inoue et al. ..... 355/274
4,549,803 10/1985 Ohno et al. ..... 219/216 X
4,712,906 12/1987 Bothner et al. ..... 355/271
4,849,803 7/1989 Ohno et al. ..... 219/216 X

*Primary Examiner*—A. T. Grimley
*Assistant Examiner*—Christopher Horgan
*Attorney, Agent, or Firm*—Fitzpatrick, Cella, Harper & Scinto

[57] ABSTRACT

An image forming apparatus includes an image bearing member; a device for forming an image on the image bearing member; a device for transferring the image from the image bearing member to an image receiving material, the transfer device including a device for carrying the image receiving material to an image transfer position where the image transfer device is operable, and the carrying device is capable of supporting plural image receiving materials simultaneously; a device for fixing the image having been transferred onto the image receiving material, the fixing device being selectively operable at a first fixing speed and a second fixing speed which is lower than the first fixing speed; wherein when the fixing device operates at the second fixing speed, the carrying device carries only one image receiving material.

18 Claims, 6 Drawing Sheets

IMAGE FORMING APPARATUS WHICH SETS FIXING ROLLER SPEED DEPENDING ON THE NUMBER OF COPIES ON THE TRANSFER DRUM

FIELD OF THE INVENTION AND RELATED ART

The present invention relates to an image forming apparatus comprising an image receiving material carrying means for carrying an image receiving material, more particularly to an image forming apparatus in which an image is formed on an image bearing member through an electrophotographic process or an electrostatic recording process, and the image is transferred onto the image receiving material on the carrying means in the form of an image transfer drum, for example, and the image transfer operation is repeated to obtain a multi-color image.

As for an image forming apparatus comprising the image receiving material carrying means such as an image transfer drum is known, and an example thereof is a color electrophotographic copying machine. U.S. Ser. No. 333,044 which has been assigned to the assignee of the subject application proposes such a color electrophotographic copying machine. The apparatus is shown in FIG. 1 of this application.

In FIG. 1, the photosensitive drum 6 (image bearing member) supported for rotation in the direction of an arrow is uniformly charged by a charger and is exposed to a laser beam 8 by a laser scanner unit (not shown) in accordance with color separated image information. The electrostatic latent image is visualized by a developing device 9. Here, the developing device 9 includes four developing means 9M, 9C, 9Y and 9BK which contain magenta developer, cyan developer, yellow developer and black developer, respectively. The developing means are mounted on a supporting member for reciprocation in a horizontal plane. By the reciprocation, a desired one of the developing means from the developing means 9M, 9C, 9Y and 9BK, is presented at the developing position where the developing means is faced to the photosensitive drum 6, and the electrostatic latent image on the photosensitive drum is developed.

The visualized toner image on the photosensitive drum is transferred onto the transfer material P (image receiving material) carried on the transfer device 10.

The description will be made as to the transfer device 10. It is in the form of a drum, and as shown in FIG. 2, it comprises a drum frame constituted by rings 101 and 102 and a connector 103 for connecting the rings, and a dielectric sheet 106 covering the opening defined by the drum frame. The dielectric sheet 106 functions to carry the transfer material P.

The rings 101 and 102 have respective grooves for permitting movement of separation pawls 20 shown in FIG. 1 in a normal direction of the transfer drum, at the positions of the connector 103 and at the positions opposite therefrom (not shown). The connector 103 has cut-away portions 105 to permit the separation pawls 20 to wedge into the space between the dielectric sheet 106 and the transfer material P.

Referring to FIG. 1, the transfer material P is fed to the transfer drum 10 in synchronism with the image on the transfer drum by a registration roller 28, and is attracted on the dielectric sheet 106 by electrostatic attraction means. The electrostatic attraction means is located inside the transfer drum 10, and comprises an attraction corona charger 23 for applying to the back side of the dielectric sheet 106 the electric charge having the polarity opposite to that of the toner on the photosensitive drum 6 and a conductive roller 24 disposed at the outside of the transfer drum 30. The conductive roller 24 is electrically grounded to function as an opposite electrode of the attraction corona charger 23, and also functions to inject the electric charge into the transfer material P so as to electrostatically attract the transfer material P onto the dielectric sheet 106. The conductive roller 24 so disposed that the gap from the dielectric sheet 106 is 0–100 microns, for example upon the attraction.

When a continuous copying mode is selected on an unshown operating panel, and when the length of the transfer material measured in the direction of its conveyance is less than one half the circumferential length of the transfer drum deducted by the width of the connector (the transfer material carriable region), the second transfer material is fed subsequent to the first sheet, so that the first and second transfer materials are attracted on the dielectric sheet 106 at the diametrically opposite positions. Thus, the dielectric sheet carries two sheets simultaneously. By doing so, the copying speed is substantially doubled, as compared with the case in which only one transfer material is carried on the dielectric sheet.

In the transfer step, in order to transfer the first color toner image, for example, the magenta toner image is transferred onto the first transfer material from the photosensitive drum, an image transfer corona charger 14 applies to the back side of the dielectric sheet 106 the electric charge having the polarity opposite to that of the toner. Subsequently, the same latent image is formed on the photosensitive drum, and the latent image is developed with the same first color toner, and the developed image is transferred similarly but now onto the second transfer material. By the time the first transfer material reaches the conductive roller 24 again, the conductive roller 24 is moved away from the dielectric sheet 106 by, for example, not less than 2 mm so as not to disturb the transferred toner images.

After the first color toner image is transferred, a second toner image (cyan toner image in this embodiment) which is formed on the photosensitive drum in synchronism with the first transfer material now having the first color toner image is transferred onto the first transfer material by the transfer corona charger 14.

Similarly, the second color toner image is transferred onto the second transfer material. Similarly, the third color toner images and the fourth color toner images are transferred onto the two transfer sheets, when a full-color image is to be formed After the completion of the image transfer step, in order to weaken the attraction of the transfer material onto the dielectric sheet 106, a pair of AC corona dischargers 15 and 16 disposed across the dielectric sheet 106 are operated.

In order to separate the first transfer material from the dielectric sheet 106, outside separation rollers 19 integrally movable with the separation pawls 20 and guided by the grooves 104 and 104 of the rings are abutted to the dielectric sheet 106, so that the outside separation rollers 19 are moved along the cut-away portions of the connector 103, and the separation pawls 20 are wedged into the space between the leading edge of the first transfer material and the dielectric sheet 106 at a position where the curvature of the dielectric sheet 106 is locally large, and therefore, the transfer material is separated from the dielectric sheet 106.

In order to separate the second transfer material from the dielectric sheet 106, an inside separation abutment roller 15 which is freely rotatable is abutted to the dielectric sheet 106, and the outside abutment rollers 19 are guided by the grooves in the ring at positions opposite from the connector 103 and are urged to the dielectric sheet 106 to locally reduce the curvature of the dielectric sheet 106, thus separating the leading edge of the transfer material, and then the separating pawls 20 are wedged into the space between the transfer material P and the dielectric sheet 106, and therefore, the transfer material P is separated from the dielectric sheet 106. In order to prevent the disturbance to the image by the separation discharge which occurs at the time of separation between the transfer material P and the dielectric sheet 106, it is desirable that the AC corona discharge is effected using the corona discharger 17 upon the separation.

When the length of the transfer material measured in the direction of its conveyance is larger than the above-mentioned, it is attracted on the dielectric sheet 106 with its leading edge at the same position as the leading edge of the above-described first one of the transfer material, irrespective of whether the copying mode is a single mode or a continuous mode. The transfer and separating operations are the same as in the first transfer material. In this case, the inside separation roller 18 is not operated.

In any case, after the completion of the transfer and separating operation, the transfer material is conveyed to the fixing device 26 on a conveying belt 25.

The transfer drum 10 from which the transfer material has been separated is cleaned by a cleaning device 13. Similarly, the photosensitive drum 6 after the toner image transfer is subjected to the discharge by a pre-discharger 11 so that the electric charge of the residual toner is partly removed, and then is cleaned by the cleaner 12.

In the image forming apparatus described above, the transfer drum can carry two transfer materials when plural copies are continuously produced, and therefore, the copying speed can be increased.

The transfer material having received the image transfer is subjected to the image fixing operation by the fixing device. However, when the image fixing property is considered, the fixing speed may be changed depending on the material of the transfer sheet, as disclosed in U.S. Pat. No. 4,549,803. However, if two transfer sheets are attracted on the transfer drum and receive the image and are separated, and if the fixing device 26 fixes the image at a lower speed, the second transfer material catches up to the first transfer material which is in the fixing device. If this occurs, the images on the first and second transfer materials are disturbed, or sheets or sheet is jammed. In order to avoid this, it would be considered that the conveying speed of the conveying belt 25 is lowered corresponding to the lowered fixing speed. However, the length of the conveying belt is not so large as carrying thereon two transfer sheets simultaneously without overlapping, and therefore, if the speed of the fixing device and the speed of the conveying belt are simultaneously lowered when the first transfer material enters the fixing device, the second transfer material is looped adjacent the separation pawl 20 due to the difference between the speed of the conveying belt 25 and the normal speed of the transfer drum 10, to such an extent that it is contacted to the corona discharger 17 or the like. Therefore, the image is also disturbed, or the sheet is jammed.

SUMMARY OF THE INVENTION

Accordingly, it is a principal object of the present invention to provide an image forming apparatus in which the disturbance of the image or the jam is presented even if the fixing speed of the fixing device is changed, so that the good quality of the images can be provided at all times.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
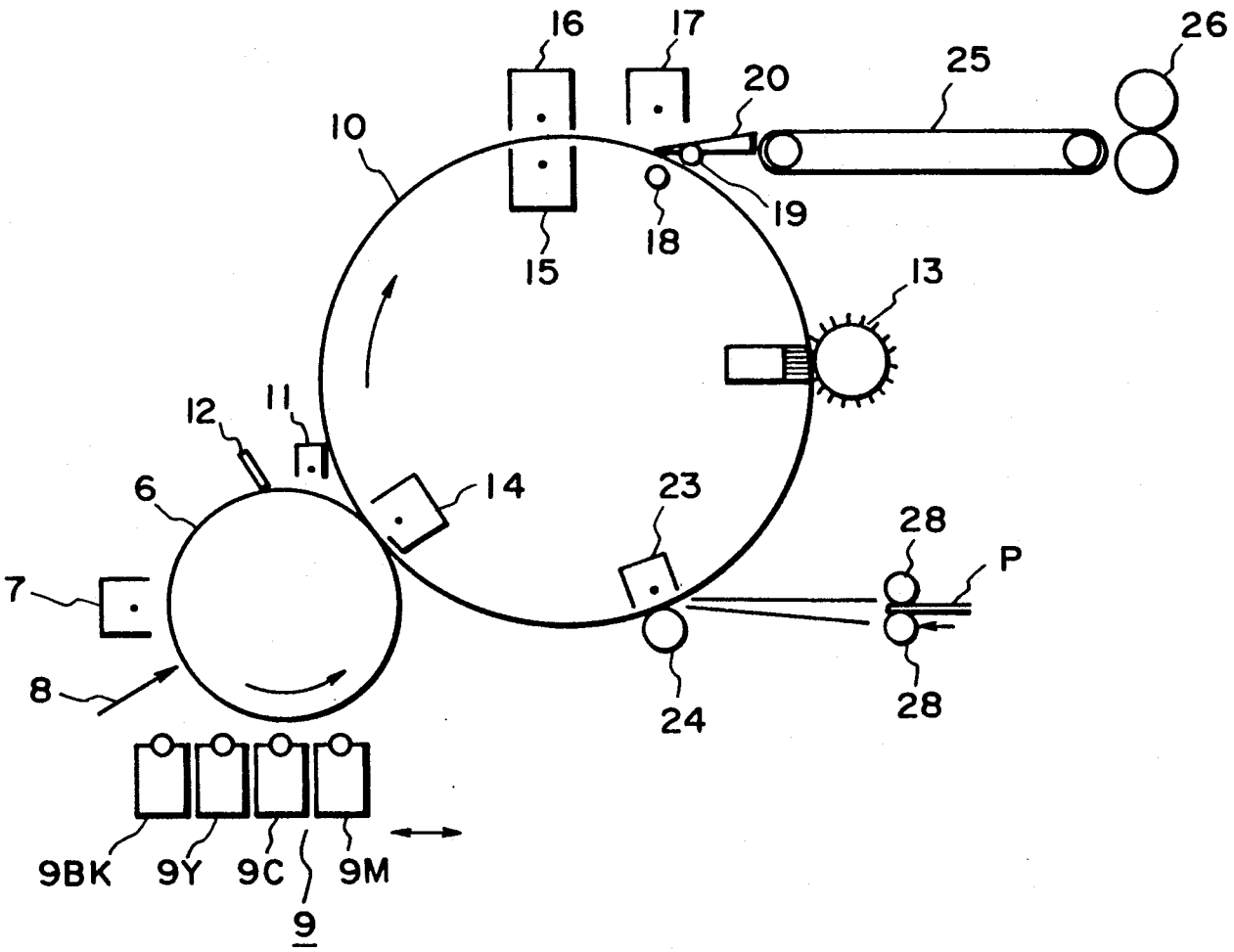
FIG. 1 is a sectional view of an image forming apparatus according to an embodiment of the present invention.
Figure 2:
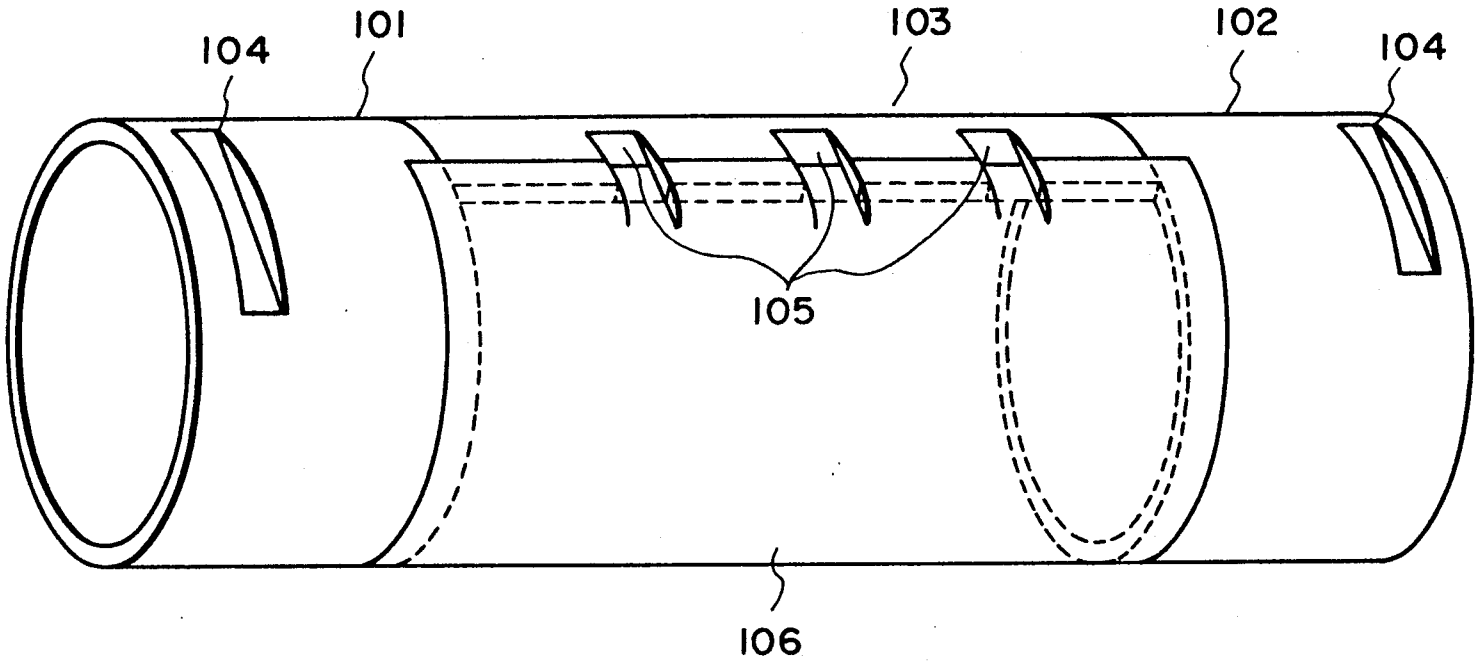
FIG. 2 is a perspective view of the transfer drum.
Figure 3:
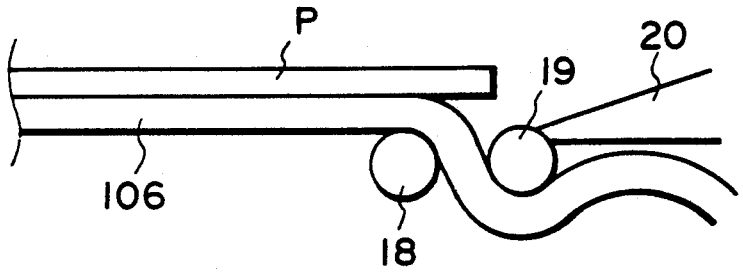
FIG. 3 illustrates a transfer material separating operation.

Referring to FIG. 1, there is shown an image forming apparatus to which the present invention is applicable. The image forming process is the same as described hereinbefore, and the description thereof is omitted for simplicity.

Figure 4:
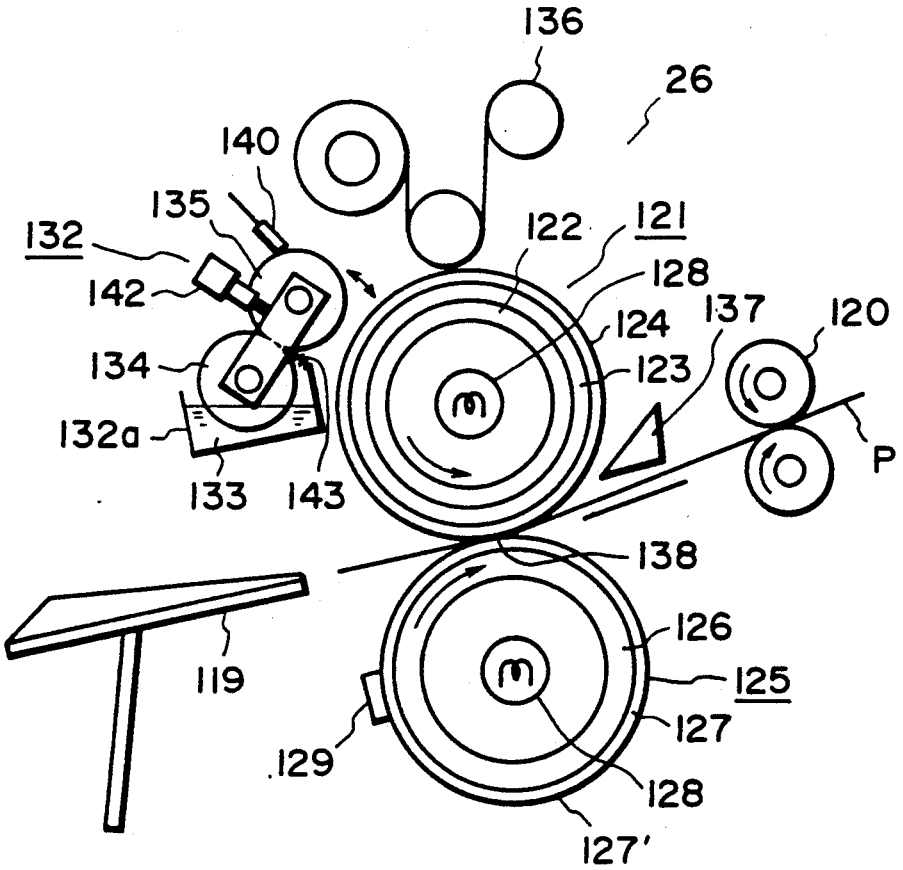
FIG. 4 is a sectional view of the fixing apparatus.

Referring to FIG. 4, the fixing device in the apparatus of this embodiment will be described.

The fixing device 26 comprises an image fixing roller 121 and a pressing roller 125 which constitute a pair of rotatable members. The rollers 121 and 125 are press-contacted to each other and are rotated in the directions indicated by arrows. The fixing roller 121 includes an aluminum core metal 122, HTV silicone rubber (silicone rubber vulcanized at high temperature) layer 123 having a proper thickness, and an LTV silicone rubber (silicone rubber vulcanized at low temperature) layer 124 having a thickness of 200 microns thereon. The pressing roller 125 includes an aluminum core metal 126, an HTV silicone rubber layer 127 having a proper thickness thereon, and a surface resin coating 127' thereon. In each of the fixing roller 121 and the pressing roller 125, there are halogen heater 128 functioning as heating sources. To the pressing roller 125, a thermister 129 is contacted, and on the basis of the output of the thermister 129, the electric power supply to the halogen heater 128 is on-off-controlled. In this manner, the surface temperatures of the fixing roller 121 and the pressing roller 125 are maintained at a proper level (170° C., for example) at a proper level for fixing the toner image on the transfer material P.

On the other hand, in order to increase the parting property of the toner from the fixing roller 121, the fixing device 26 is provided with a parting agent applying means 132 at proper position. The parting agent applying means 132 takes the silicone oil 133 (dimethylsilicone oil KS96 300CS, available from Shinetsu Kagaku Kabushiki Kaisha, Japan) from the oil container 132*a* by rollers 134 and 135, and the silicone oil 133 is regulated to a predetermined amount by the adjusting blade 140, and then is applied to the fixing roller 121.

The transfer material P is passed through the nip 138 formed between the fixing roller 121 and the pressing roller 125, by which the toner image is fixed on the transfer material P by the pressure and the heat by the rollers.

In FIG. 4, designated by a reference 119 is an inlet guide for introducing the transfer material P into the nip between the fixing roller 121 and the pressing roller 125, and a reference numeral 120 designates a pair of discharging rollers for discharging the transfer material P having been subjected to the image fixing operation. Reference numerals 136 and 137 designate a cleaning web for cleaning the surface of the fixing roller 121, and a pawl for preventing the transfer material P from wrapping around the fixing roller 121.

The transfer material is usually made of paper, particularly such paper as has a basis weight of 50–90 g/m$^2$. However, the recent wide needs require that various materials are usable, such as thick paper having the basis weight of 90–150 g/m$^2$ or resin film. Particularly, the latter is frequently OHP (overhead projector) film which is transparent. When such transfer material is used, it is usually required that the fixing operation is effected at a lower speed than the ordinary paper.

In this embodiment, the process speed of the image forming means is 84 mm/sec, and the fixing speed which is the peripheral speed of the roller of the fixing device, is 84 mm/sec; that for the thick sheet, OHP film or the like, the lower fixing speed is selected, more particularly, 25 mm/sec.

The reason why the lower speed is used is that if the same speed is used, the quantity of the heat is not enough to fuse the toner with the result that the resultant image does not have the sufficient glossiness or that the toner does not adhere to the transfer material (cold off-set). This tends more to occur in the case of color image formation, since two–four layers of the toner are superposed on the transfer material, and therefore, the heat from the fixing roller is not easily transmitted to the bottom layer, so that the bottommost toner layer is not easily fused, and since the heat from the backside does not reach the bottom toner through the thick sheet, and therefore, the bottommost toner is not anchored to the sheet. Then, the toner is easily removed from the sheet.

When the transfer material is a resin film, the heat is not easily transmitted as in the case thick sheet, and in addition, the surface of the film is too smooth to provide sufficient toner anchoring effect, so that the tone is easily removed from the surface of the film. Therefore, it is usually required that the fixing speed is lowered.

In the case of the OHP film, it is generally required to lower the fixing speed so that the image is formed in clear color and with sufficient light transmissivity and the color is good when the image is projected by the OHP projector, so that the toners are sufficiently fused and mixed.

The developer used in this embodiment will be briefly described.

In the case of the multi-color image formation or full-color image formation, the toner having a sharp melting property is desirable since then the reproducible color range is increased, and the faithfulness the color copy is good.

The toner is made of binder resin such as polyester resin or styrene acrylic ester resin, coloring agent (dye or sublimating dye) and other materials such as electrification controlling agent. They are fused, kneaded, pulverized and classified. As desired, various additives such as hydrophobic colloidal silica, for example, are added.

In the case of the color toner, the binder resin is preferable polyester resin from the standpoint of good fixing property and sharp melting property. As an example of the sharp melting polyester resin, there is a high polymer having an ester linkage in the main chain of the molecules synthesized from diol compound and dicarboxylic acid.

Particularly the flowing is desirable

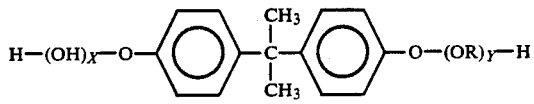

Figure 5:
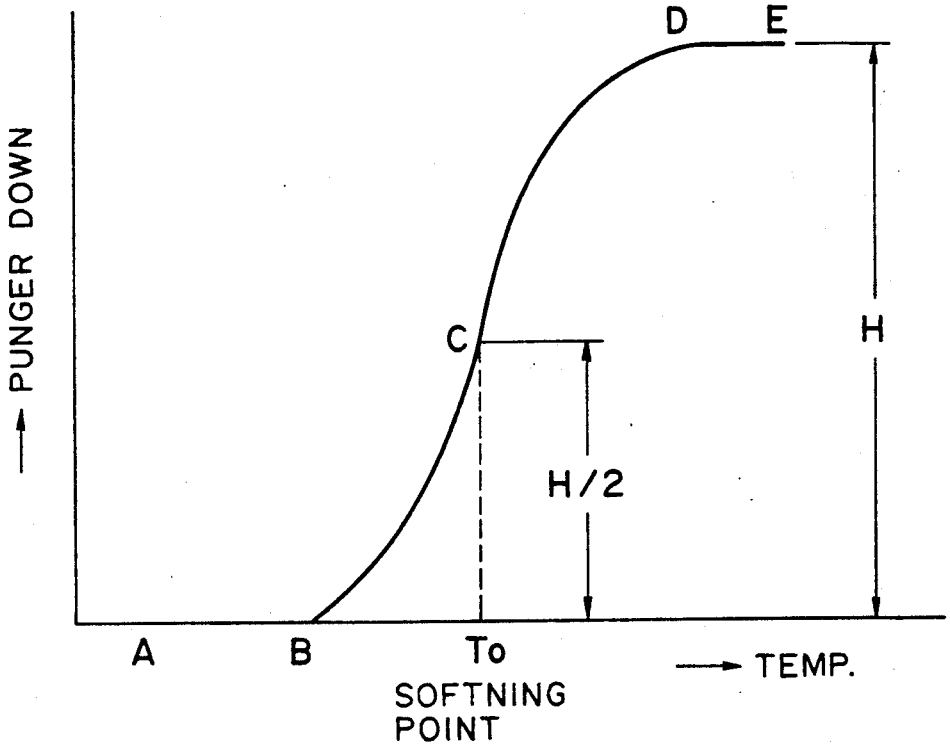
FIG. 5 is a graph showing the softening characteristics of the toner.

(R is ethylene or radical group, X and Y are positive integers not less than 1, wherein an average of X+Y is 2–10) the diol component is a derivative of bisphenol or its replacement, and dicarboxylic acid is carboxylic acid of not less than divalent, its acid anhydride or lower alkyl ester carboxylic acid (for example, fumaric acid, maleic acid, anhydride maleic acid, phthalic acid, terephthalic acid, trimellitic acid or pyromellitic acid. They are at least polymerized and condensated into the polyester resin. It exhibits sharp melting properties. The softening point of the polyester resin is 75°–150° C., preferably 80°–120° C. The softening property of the toner containing the binder resin (polyester resin) is shown in FIG. 5.

The measuring method of the softening point will be described. A flow tester CFT-500A (available from Shimazu Seisakusho Kabushiki Kaisha, Japan) having a die (nozzle diameter of 0.2 mm and a thickness of 1.0 mm) is used. The toner is heated at a constant temperature increasing speed of 6° C./min. under the pushing load of 20 kg with the initial temperature of 70° C. under the pre-heating period of 300 sec. The plots of the plunger lowering amount vs. temperature (softening S-curve) is determined. The toner is fine powder, and the weight thereof is correctly measured (1–3 g). The cross-sectional area of the plunger is 1.0 cm$^2$. The S-curve is as shown in FIG. 5. With the constant speed temperature rise, the toner is gradually heated, and its starts to flow (the plunger lowering from A to B). With continued temperature rise, the fused toner flows out greatly (B-C-D) until the plunger stops (D-E).

The height H of the S-curve represents the total amount of flow, and the temperature TO corresponding to the point C (H/2) is the softening point of the material (toner or resin, for example).

Whether the toner or the binding resin has the sharp melting property or not, is discriminated by measuring the apparent viscosity of the toner or the binding resin.

The sharp melting property of the toner or the binder resin is defined as satisfying the following:

$$T1 = 90 - 150° C.$$

$|\Delta T| = |T1 - T2| = 5 - 20°C.$ where T1 is the temperature when the apparent viscosity is $10^3$ poise, and T2 is the temperature when the viscosity is $5 \times 10^2$.

The resin having the sharp melting property is characterized by the sharp decrease of the viscosity when it is heated.

Such viscosity decrease properly mixes the top toner layer and the bottom toner layer, and also abruptly increases the transparency of the toner layer, and enable the subtractive color mixture.

The description will be made as to the image formation process when the fixing roller and the pressing roller are rotated to provide the lower speed fixing operation in the fixing device.

Figure 6:
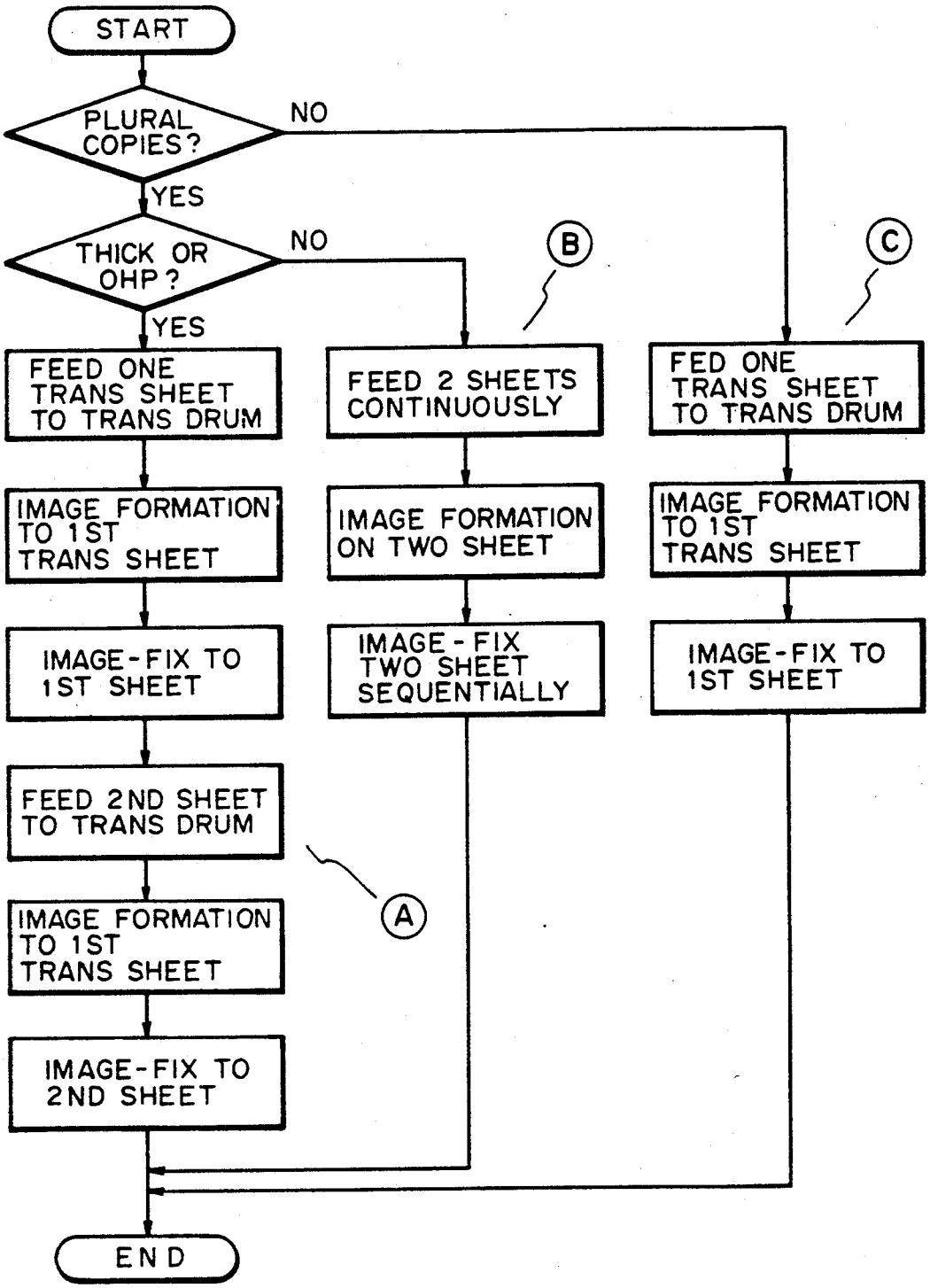
FIG. 6 is a flow chart of sequences of the image forming operation in the present invention.

When the transfer material is a thick sheet, a resin film or the like that requires the fixing speed to be lowered, only one transfer material is attracted on the dielectric sheet 106 from the connector 103 of the transfer drum, even if the plural number of copies are set on the unshown operating panel. The image forming operation is performed only for the one sheet. After the four color image forming operations are completed to provide the full-color image, the transfer material is separated by the separation pawls 20 from the dielectric sheet 106 and is conveyed by the conveyor belt 25 to the fixing device 26 where it is subjected to the image fixing operation at the lower speed. Thereafter, the second transfer material is fed, and the same image forming and fixing operations are performed. The sequences of the image forming operation are shown in FIG. 6 (A). In FIG. 6, (B) represents the case wherein plural copies are produced on the usual sheet, and (C) represents the case in which one copy is to be produced irrespective of the material of the transfer sheet.

The same image forming operation is repeated even if third or fourth copies are to be produced.

Therefore, even if plural copies are produced, the image disturbance or the sheet jam do not occur, so that the image transfer and fixing operations are performed in good order.

In the above sequence, the timing of the second transfer material feed may take place after the first transfer material is discharged to the outside of the fixing device 26 at the lower speed. In the case of the full color image formation (four colors or the like), the four image transfer operations are carried out, and therefore, the second transfer material may be fed during the period in which the first sheet is being fixed at the lower speed. In this case, it is desirable that the first transfer material has passed through the fixing device by the time when the second transfer material reaches the fixing device.

Figure 7:
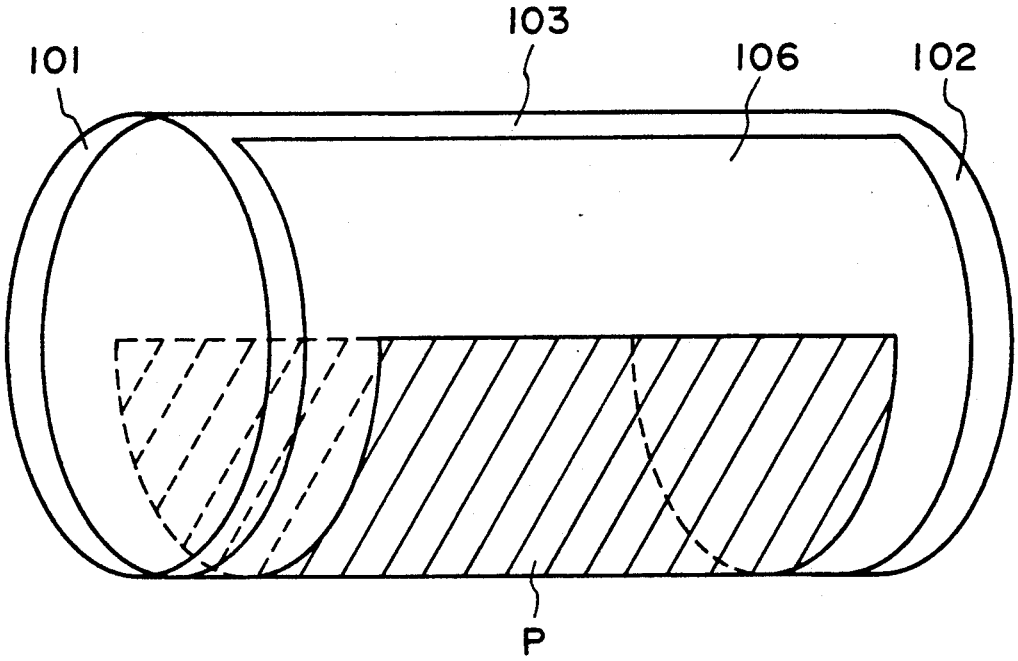
FIG. 7 is a perspective view in which one transfer material is carried on a dielectric sheet of the transfer drum.

The position where the transfer material is attracted on the transfer drum may be between the first and second sheet positions at the time of the normal sheet used. More particularly, the single sheet may be attracted at the position diametrically opposite to the connector 103, as shown in FIG. 7. (In the case of the ordinary transfer materials, the first one of them is attracted from the connector 103, and the second is attracted following it.) In the case of the thick sheet or the resin film, the position is particularly preferable in consideration of the rigidity of such a sheet.

The detection of the material of the transfer sheet (whether it is a thick sheet or a resin film), is made on the basis of the selection on the operating panel, or by a photosensor or a sheet thickness detecting sensor disposed before the registration roller 28 or between the registration roller 28 and the conductive roller 24, so that the detection is automatically.

In the case wherein the image forming apparatus is a printer operated under the instructions from the computer rather than the copying machine receiving various functions from the operating panel has in this embodiment, the discrimination as to whether or not it is the thick sheet or resin film may be made on the basis of the instructions from the computer.

In this embodiment, only one sheet is carried on the transfer drum in the low speed mode of the fixing device even if two transfer materials can be carried thereon (A4 or B5 size). In the case where only one sheet can be supported on the transfer drum because of the size of the transfer material, the transfer drum carries only one sheet irrespective of the speed of the fixing device.

In the foregoing description, the image receiving material carrying means has been in the form of a transfer drum, but it may be in the form of a belt or a bias roller to which a predetermined bias voltage is applied without use of the corona transfer charger.

Besides the electrostatic attraction of the transfer material on the transfer drum, the transfer material may be carried on the transfer drum by a gripper or air sucking means, in which the transfer drum has two connecting portions 103 having respective grippers or respective air sucking holes, by which two transfer sheets can be carried on the dielectric sheet. In this case, only one of the grippers or only the air sucking holes in one of the connectors 103 is used in the low speed mode of the fixing device. Where the transfer device has a capacity of carrying three or more sheets, the effects of the present invention are used if only one sheet is carried thereon in the low speed mode. In the foregoing description, the image forming apparatus has been of such an image transfer type that the image is transferred from the photosensitive drum to the transfer material carried on the transfer drum, but the present invention is applicable to the case that an image forming means directly forms an image on the image receiving material carried on the image receiving material carrying means.

As described in the foregoing, according to the present invention, the image receiving material carrying means such as a transfer drum carries only one sheet in the low fixing speed mode even if plural image formations are required. Accordingly, the image receiving material is prevented from catching up the first sheet to disturb the image or to cause the sheet jam. Therefore, good image forming operations can be maintained.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing means;

means for forming an image on said image bearing means;

means for transferring the image from said image bearing means to an image receiving material, said transfer means including means for carrying the image receiving material to an image transfer position where said image transfer means is operable, and said carrying means is capable of supporting plural image receiving materials simultaneously;

means for fixing the image having been transferred onto the image receiving material, said fixing means being selectively operable at a first fixing speed and a second fixing speed which is lower than the first fixing speed;

wherein when said fixing means operates at the first speed, said carrying means selectively carries one image receiving material or plurality of image receiving materials simultaneously and when said fixing means operates at the second fixing speed, said carrying means carries only one image receiving material.

2. An apparatus according to claim 1, wherein the first and second speeds are selected in accordance with the material of which the image receiving material is made.

3. An apparatus according to claim 2, wherein when said image receiving material is made of resin sheet, the second fixing speed is selected.

4. An apparatus according to claim 1, wherein the image receiving material is electrostatically attracted on said image receiving material carrying means.

5. An apparatus according to claim 1, wherein the image receiving material carrying means includes a drum frame having cylindrical rings at opposite longitudinal ends and a connector for connecting the rings and a dielectric sheet stretched to cover an opening defined by the rings and the connector, wherein the image receiving material is carried on the dielectric sheet.

6. An apparatus according to claim 5, wherein said carrying means rotates carrying the image receiving material to pass through the transfer station so that plural images are superposedly transferred onto the image receiving material.

7. An apparatus according to claim 6, wherein on said image receiving material, a full-color image is formed.

8. An apparatus according to claim 7, wherein said fixing means is a heat fixing means which fixes the image by heat.

9. An apparatus according to claim 5, wherein when said fixing means operates at the second fixing speed, the image receiving material is carried on the dielectric sheet diametrically opposite from the connector.

10. An apparatus according to claim 1, wherein even if plural image formations are instructed, only one image receiving material is carried on said carrying means when said fixing means operates at the second fixing speed.

11. An apparatus according to claim 1, wherein said fixing means includes a pair of rotatable members rotatable at first and second peripheral speeds corresponding to said first and second fixing speeds.

12. An apparatus according to claim 5, wherein said carrying means is capable of carrying plural image receiving materials having lengths as measured along their conveyance direction of not more than one half a circumferential length of said carrying means.

13. An apparatus according to claim 1, wherein when the image receiving material is of standard size paper, said first fixing speed is selected.

14. An image forming apparatus, comprising:

an image bearing means;

means for forming an image on said image bearing means;

means for transferring the image from said image bearing means to an image receiving material, said transfer means including means for carrying the image receiving material to an image transfer position where said image transfer is performed, and said carrying means is capable of supporting plural image receiving materials simultaneously;

means for fixing the image having been transferred onto the image receiving material, said fixing means being selectively operable at a first fixing speed and a second fixing speed which is lower than the first fixing speed;

wherein the number of image receiving materials which said carrying means carries is different in accordance with a selected one of the fixing speeds.

15. An image forming apparatus, comprising:

an image forming means for forming an image on an image receiving material;

means for carrying the image receiving material, said carrying means being capable of carrying plural image receiving materials simultaneously;

means for fixing an image on the image receiving material, said fixing means being operable selectively at a first fixing sped and a second fixing speed which is lower than the first fixing speed, wherein when said fixing means operates at the first fixing speed, said carrying means selectively carries one image receiving material or plural image receiving materials simultaneously and when said fixing means operates at the second fixing speed, said carrying means carries only one image receiving material.

16. An apparatus according to claim 15, wherein the first or second fixing speed is selected in accordance with material of which the image receiving material is made.

17. An apparatus according to claim 1, wherein when said fixing means operates at the first fixing speed, the number of the image receiving materials carried on said carrying means is selected in accordance with the size and number of the image recording materials on which images are formed.

18. An apparatus according to claim 15, wherein when said fixing means operates at the first fixing speed, the number of the image receiving materials is carried on said carrying means is selected in accordance with the size and number of the image recording materials on which images are formed.

* * * * *

UNITED STATES PATENT AND TRADEMARK OFFICE

CERTIFICATE OF CORRECTION

PATENT NO. : 5,075,732

DATED : December 24, 1991

INVENTOR(S) : Takeshi MENJO

It is certified that error appears in the above-identified patent and that said Letters Patent is hereby corrected as shown below:

In the Drawings, sheet 4,

"PUNGER" should read --PLUNGER--; and
"SOFTNING" should read --SOFTENING--.

COLUMN 6:

Line 2, "faithfulness" should read --faithfulness of--; and
Line 18, "flowing is desirable" should read --following is desirable:--.

COLUMN 7:

Line 10, "enable" should read --enables--.

COLUMN 8:

Line 6, "has" should read --as--.

COLUMN 10:

Line 4, "standard size paper," should read --standard material paper,--; and
Line 54, "is" should be deleted.

Signed and Sealed this

Thirty-first Day of August, 1993

Bruce Lehman

*Attest:*

BRUCE LEHMAN

*Attesting Officer*

*Commissioner of Patents and Trademarks*